US007777419B2

(12) United States Patent
Moon et al.

(10) Patent No.: US 7,777,419 B2
(45) Date of Patent: Aug. 17, 2010

(54) PLASMA DISPLAY PANEL

(75) Inventors: Dong-Gun Moon, Suwon-si (KR); Jae-Woo Bae, Suwon-si (KR); Jun-Kyu Cha, Suwon-si (KR); Sang-Yeol Hur, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 582 days.

(21) Appl. No.: 11/647,418

(22) Filed: Dec. 29, 2006

(65) Prior Publication Data

US 2007/0152586 A1 Jul. 5, 2007

(30) Foreign Application Priority Data

Dec. 31, 2005 (KR) ..... 10-2005-0136234

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | | |
|---|---|---|---|---|
| 5,541,618 | A | | 7/1996 | Shinoda |
| 5,661,500 | A | | 8/1997 | Shinoda et al. |
| 5,663,741 | A | | 9/1997 | Kanazawa |
| 5,674,553 | A | | 10/1997 | Sinoda et al. |
| 5,724,054 | A | | 3/1998 | Shinoda |
| 5,742,122 | A | * | 4/1998 | Amemiya et al. ..... 313/582 |
| 5,786,794 | A | | 7/1998 | Kishi et al. |
| 5,952,782 | A | | 9/1999 | Nanto |
| 6,034,474 | A | | 3/2000 | Ueoka et al. |
| RE37,444 | E | | 11/2001 | Kanazawa |
| 6,325,909 | B1 | | 12/2001 | Li et al. |
| 6,630,916 | B1 | | 10/2003 | Shinoda |
| 6,707,436 | B2 | | 3/2004 | Setoguchi et al. |
| 2005/0093452 | A1 | | 5/2005 | Lin et al. |
| 2005/0212424 | A1 | | 9/2005 | Kwon et al. |

FOREIGN PATENT DOCUMENTS

| | | |
|---|---|---|
| EP | 1 585 160 | 10/2005 |
| JP | 2845183 | 10/1998 |
| JP | 2917279 | 4/1999 |
| JP | 2001-043804 | 2/2001 |
| JP | 2001-325888 | 11/2001 |
| KR | 10-2005-0101903 | 10/2005 |

OTHER PUBLICATIONS

Korean Office Action for Korean Patent Application No. 2005-0136234, issued on Dec. 7, 2006.

(Continued)

*Primary Examiner*—Nimeshkumar D. Patel
*Assistant Examiner*—Mary Ellen Bowman
(74) *Attorney, Agent, or Firm*—Robert E. Bushnell, Esq.

(57) ABSTRACT

A plasma display panel is provided with a front substrate and a rear substrate disposed facing each other, and an electromagnetic wave shielding layer disposed between the front substrate and the rear substrate.

21 Claims, 11 Drawing Sheets

OTHER PUBLICATIONS

Chinese Office Action for Chinese Patent Application No. 2004100749350, issued on Nov. 24, 2006.

European Search Report corresponding to European Patent Application No. 07250002.8, issued on Jun. 4, 2007.

"*Final Draft International Standard*", Project No. 47C/61988-1/Ed. 1; Plasma Display Panels-Part 1: Terminology and letter symbols, published by International Electrotechnical Commission, IEC. in 2003, and Appendix A-Description of Technology, Annex B-Relationship Between Voltage Terms And Discharge Characteristics; Annex C-Gaps and Annex D-Manufacturing.

* cited by examiner

PLASMA DISPLAY PANEL

CLAIM OF PRIORITY

This application makes reference to, incorporates the same herein, and claims all benefits accruing under 35 U.S.C.§119 from an application for PLASMA DISPLAY PANEL earlier filed in the Korean Intellectual Property Office on 31 Dec. 2005 and there duly assigned Ser. No. 10-2005-00136234.

BACKGROUND OF THE INVENTION

1. Field of the Invention

The present invention relates to a plasma display panel, and more particularly, to a plasma display panel that can prevent electromagnetic waves from being emitted.

2. Description of the Related Art

Plasma display apparatuses, which use plasma display panels, are flat plate display apparatuses that use a gas discharge effect to display images. Due to their very good characteristics, such as high display capacity, high brightness, high contrast, high performance, clear latent images, wide viewing angles, slim structure, and large screen size, plasma display devices are considered to be the next generation of display devices which will replace cathode ray tubes (CRTs).

Contemporary plasma display apparatuses, however, generate electromagnetic waves during operation. Electromagnetic waves can adversely affect a variety of electronic devices and can be harmful to humans. Therefore, an invention resolving this problem is needed.

SUMMARY OF THE INVENTION

It is therefore an object of the present invention to provide an improved plasma display panel.

It is another object to provide a plasma display panel that can prevent electromagnetic waves from being emitted.

According to an aspect of the present invention, a plasma display panel is provided with a front substrate and a rear substrate disposed facing each other and forming a discharge space therebetween, and an electromagnetic wave shielding layer disposed on a surface of the front substrate that faces the rear substrate.

According to another aspect of the present invention, a plasma display panel is provided with a front substrate and a rear substrate disposed facing each other, a plurality of barrier ribs disposed between the front substrate and the rear substrate and partitioning a plurality of discharge cells, an electromagnetic wave shielding layer disposed between the front substrate and the barrier ribs, a first dielectric layer disposed to cover the electromagnetic wave shielding layer, a plurality of sustain electrode pairs disposed on the first dielectric layer and used to generate discharge in the discharge cells, a second dielectric layer covering the sustain electrode pairs, a plurality of address electrodes disposed between the barrier ribs and the rear substrate and extending as to intersect the sustain electrode pairs, a third dielectric layer covering the address electrodes, and phosphor layers formed in the discharge cells.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

The above and other features and advantages of the present invention will become more apparent by describing in detail exemplary embodiments thereof with reference to the attached drawings in which.

DETAILED DESCRIPTION OF THE INVENTION

Figure 1:
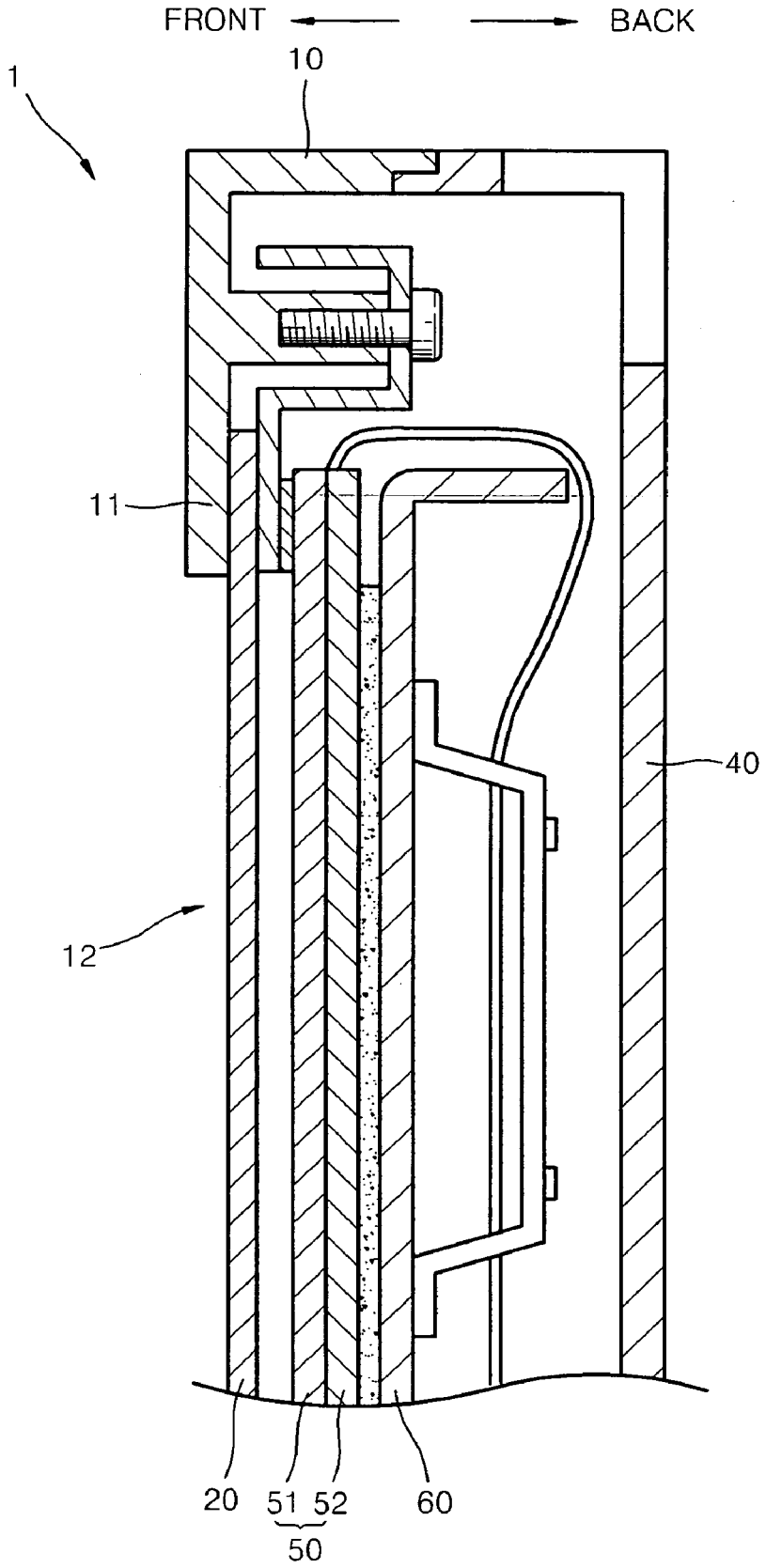
FIG. 1 is a partial cross-sectional view of a contemporary plasma display apparatus constructed with a glass-type filter.

The attached drawings for illustrating embodiments of the present invention are referred to in order to gain a sufficient understanding of the present invention, the merits thereof, and the objectives accomplished by the implementation of the present invention.

Hereinafter, the present invention will be described in detail by explaining embodiments of the invention with reference to the attached drawings. Like reference numerals in the drawings denote like elements.

FIG. 1 is a partial cross-sectional view of a contemporary plasma display apparatus 1 constructed with a glass filter. Referring to FIG. 1, plasma display apparatus 1 is constructed with a front case 10 including a peripheral part 11 for defining a window 12, a glass filter 20 for covering window 12, a plasma display panel 50 which is disposed behind glass filter 20 and includes a front panel 51 and a rear panel 52, a chassis base 60 for supporting plasma display panel 50, and a rear case 40 which is disposed behind chassis base 60 and is coupled with front case 10. Glass filter 20 is constructed with a grid pattern made from an electrically conductive metal on glass filter 20, and can block electromagnetic waves. Glass filter 20, however, is heavy, expensive and has a high volume. Particularly, as plasma display panels become larger, the size and thickness of glass filters increase accordingly, which significantly increases the cost of glass filters.

Figure 2:
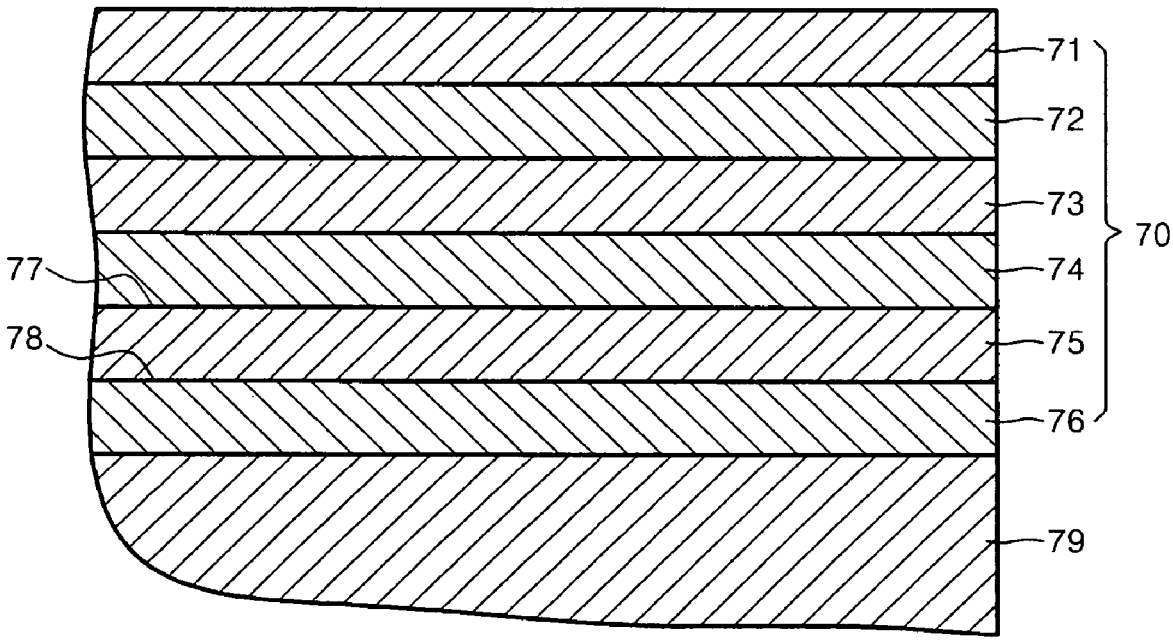
FIG. 2 is a cross-sectional view showing a contemporary film-type filter that is directly attached to the front surface of a plasma display panel.

FIG. 2 is a cross-sectional view showing a contemporary film-type filter 70 that is directly attached to front surface 78 of a plasma display panel 79. Film-type filter 70 has a structure in which an electromagnetic wave shielding layer 74, a second base film 73, a selective light absorption layer 72, and an anti-reflection layer 71 are sequentially stacked on a surface 77 of a first base film 75. Film-type filter 70 is lighter and has a lower volume compared to glass filter 70 of the contemporary plasma display apparatus 1 (FIG. 1). First base film 75 is further constructed with an adhesive layer 76 formed partially or entirely on either the major surface of first base film 75, or the major surface of plasma display panel 79; and first base film 75 is fixed to plasma display panel 79 by adhesive layer 76.

Electromagnetic wave shielding layer 74 is generally formed in a grid pattern. Electromagnetic wave shielding layer 74 formed in the grid pattern, however, causes interference with plasma display panel 79, thus generating a moiré phenomenon. The moiré is a phenomenon when two layers of grids are overlaid at an angle, or when two layers of grids have slightly different mesh sizes, resulting in an interference pattern. Also, since the grid pattern is formed over a light-emitting area of plasma display panel 79, light transmittance of plasma display panel 79 is lowered and thus brightness of plasma display panel 79 is reduced. In order to avoid the problem, if electromagnetic wave shielding layer 74 is formed as an electrically conductive film, the light transmittance can be improved, however, electromagnetic wave shielding efficiency is lowered and may not satisfy the electromagnetic interference (EMI) blocking standard. Also, increasing the thickness of the electrically conductive film in order to improve the electromagnetic wave shielding efficiency reduces the light transmittance.

Figure 3:
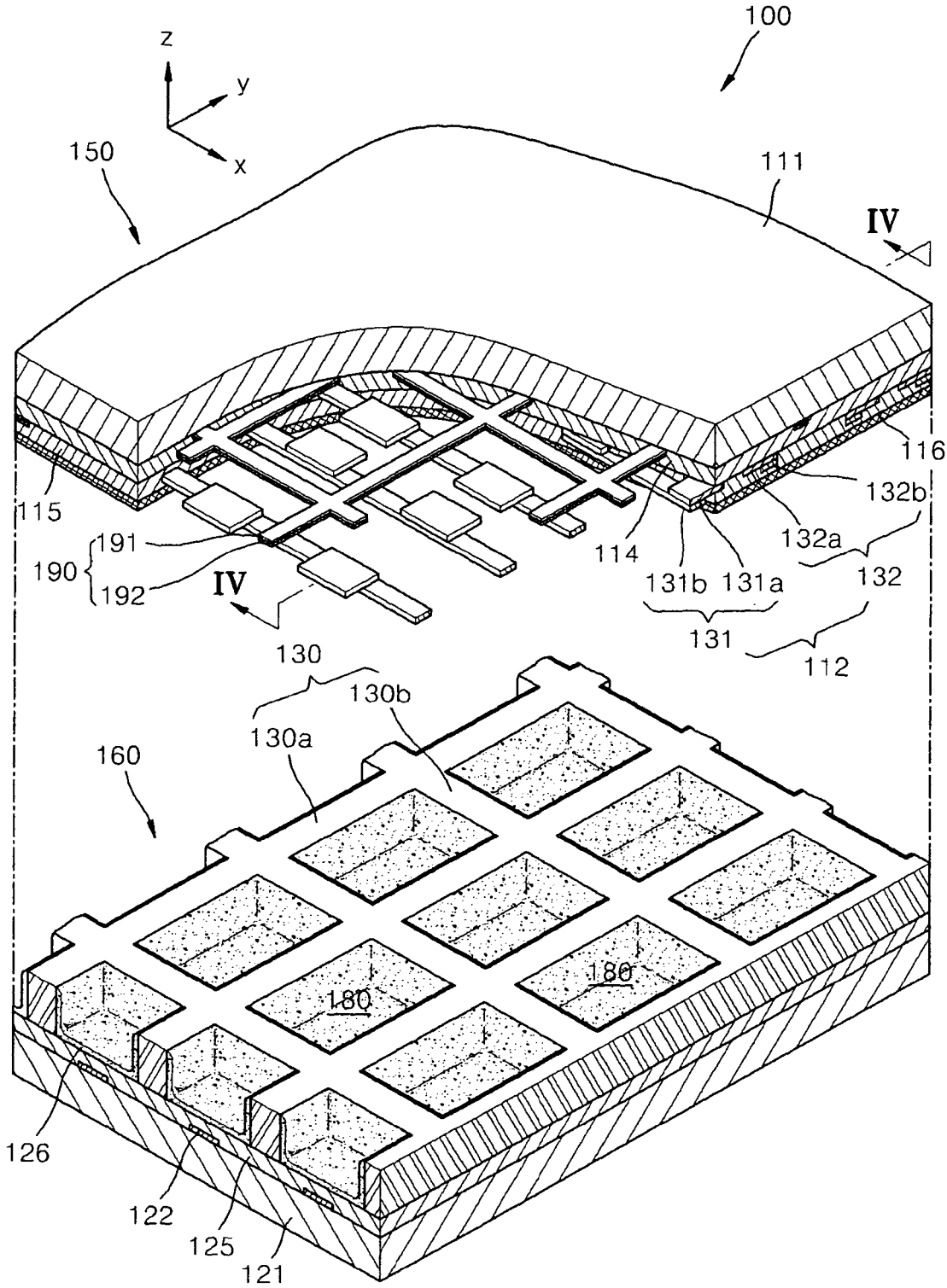
FIG. 3 is a partially exploded perspective view showing a plasma display panel constructed as a first embodiment of the principles of the present invention.
Figure 4:
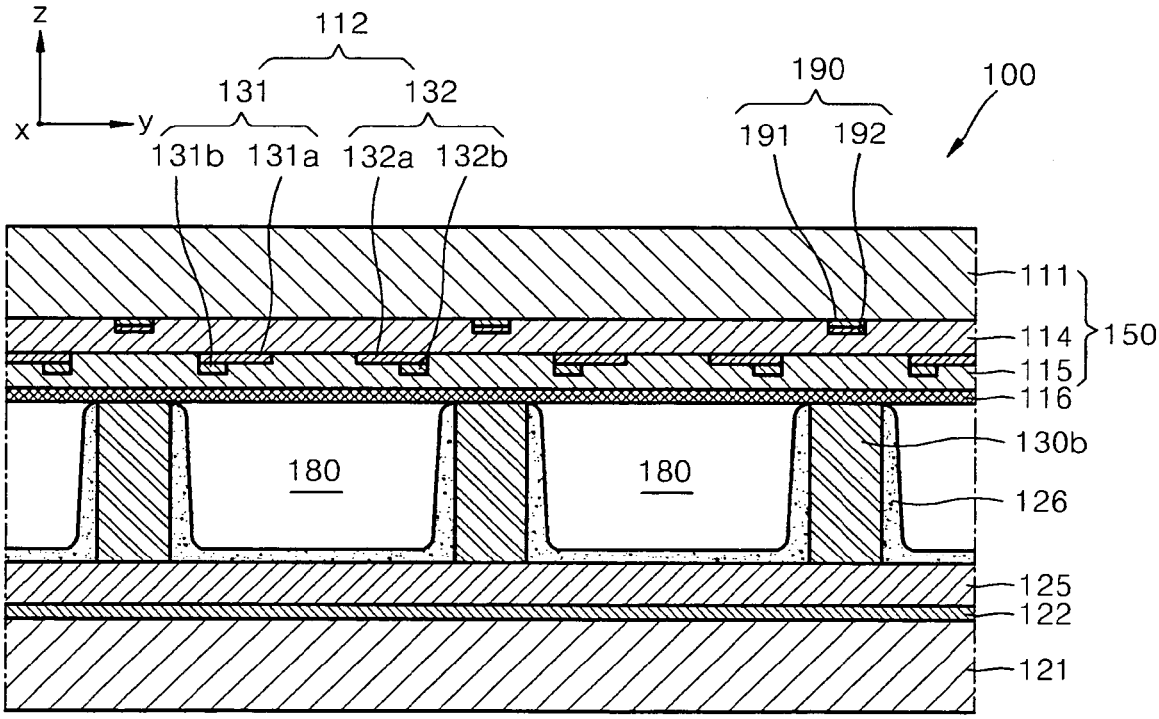
FIG. 4 is a cross-sectional view of the plasma display panel of FIG. 3 taken along line IV-IV of FIG. 3, according to the first embodiment of the principles of the present invention.
Figure 5:
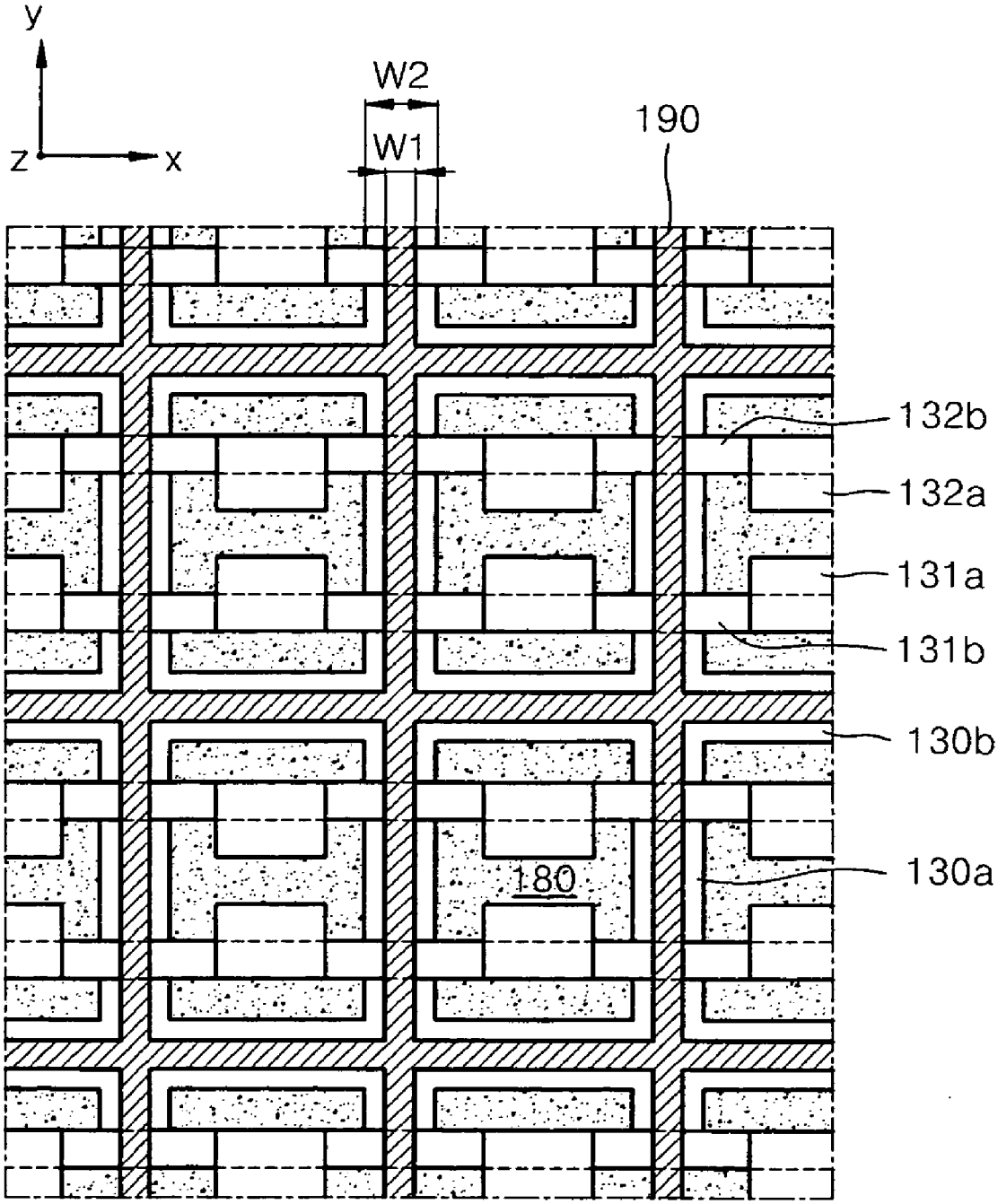
FIG. 5 is a plan view showing an arrangement of sustain electrode pairs, barrier ribs, and an electromagnetic wave shielding layer of the plasma display panel of FIG. 3, according to the first embodiment of the principles of the present invention.

FIGS. 3, 4, and 5, are views of a plasma display panel 100 constructed as a first embodiment of the principles of the present invention. FIG. 3 is a partially exploded perspective view showing plasma display panel 100 according to the first embodiment of the principles of the present invention, FIG. 4 is a cross-sectional view of plasma display panel 100 taken along line IV-IV of FIG. 3, and FIG. 5 is a plan view showing an arrangement of sustain electrode pairs, barrier ribs, and an electromagnetic wave shielding layer of plasma display panel 100 of FIG. 3, according to the first embodiment of the principles of the present invention.

Referring to FIGS. 3 and 4, plasma display panel 100 is constructed with a front panel 150, and a rear panel 160 facing and coupled with front panel 150. Front panel 150 is constructed with a front substrate 111, an electromagnetic wave shielding layer 190, a plurality of sustain electrode pairs 112, a first dielectric layer 114, a second dielectric layer 115, and a protection layer 116. Rear panel 160 is constructed with a rear substrate 121, a plurality of address electrodes 122, a third dielectric layer 125, a plurality of barrier ribs 130, and a plurality of phosphor layers 126.

Rear substrate 121 and front substrate 111 are arranged facing each other and are spaced apart from each other so that a discharge space for generating a plasma discharge is formed between rear substrate 121 and front substrate 111. Preferably, front substrate 111 and rear substrate 121 are made from glass having high light transmittance so that visible light generated from phosphor layers 126 can be transmitted through rear substrate 121 and front substrate 111. In order to improve contrast, however, front substrate 111 and/or rear substrate 121 may be colored.

Barrier ribs 130 are disposed between front substrate 111 and rear substrate 111. In more detail, barrier ribs 130 are disposed on third dielectric layer 125. Barrier ribs 130 partition the discharge space into a plurality of discharge cells 180 and prevents optical and electric crosstalk between discharge cells 180. Referring to FIG. 3, barrier ribs 130 include first barrier rib portions 130*a* which are parallel to address electrodes 122 and extend in a Y direction, and second barrier rib portions 130*b* which connect neighboring first barrier rib portions 130*a* to each other and extend in an X direction.

In FIG. 3, discharge cells 180, which are partitioned by barrier ribs 130, have a square cross-section and are arranged in a matrix form. The present invention is, however, not limited to this structure. That is, barrier ribs 130 can be formed so that discharge cells 180 have a polygonal cross-section, such as a triangular cross-section, a pentagonal cross-section, etc., or a circular or oval cross-section, etc. Also, barrier ribs 130 can allow discharge cells 180 to be formed in an open structure, such as a stripe form. Also, barrier ribs 130 can partition discharge cells 180 into a waffle form, a delta form, etc.

Electromagnetic wave shielding layer 190 is formed on a surface of front substrate 111 that faces rear substrate 121. Electromagnetic wave shielding layer 190 shields electromagnetic waves generated by plasma display panel 100. Electromagnetic wave shielding layer 190 can be formed in a variety of patterns. Preferably, electromagnetic wave shielding layer 190 is formed in a grid pattern or a mesh pattern in order to increase the effectiveness of the electromagnetic wave shielding and to aid the manufacture of electromagnetic wave shielding layer 190. The mesh pattern of electromagnetic wave shielding layer 190 is not confined to a rectilinear geometric shape, and could have other geometric shapes such as an ellipsoidal shape, circular shape or triangular shape.

Electromagnetic wave shielding layer 190 can be formed in a single layer structure or in a multi-layer structure. Referring to FIG. 4, electromagnetic wave shielding layer 190 is constructed with a first shielding portion 191 which is disposed on front substrate 111 and has a light absorption property, and a second shielding portion 192 which is disposed on first blocking unit 191 (i.e., first shielding portion 191) and has an excellent electrical conductivity. First shielding portion 191 is tinted and therefore first shielding portion 191 absorbs external light and improves contrast. Also, since second shielding portion 192 has an excellent electrical conductivity, second shielding portion 192 improves electromagnetic wave shielding efficiency.

Referring to FIGS. 3 and 4, electromagnetic wave shielding layer 190 can be disposed at different locations. In order to increase forward light transmittance from discharge cells 180, however, electromagnetic wave shielding layer 190 is preferably disposed corresponding to a non-discharge region. Particularly, electromagnetic wave shielding layer 190 is more preferably disposed on the area of front substrate 111 corresponding to barrier ribs 130. This is because, if the grid pattern of electromagnetic wave shielding layer 190 is substantially similar to the pattern of barrier ribs 130, a moiré pattern caused by interference between the grid pattern of electromagnetic wave shielding layer 190 and the pattern of barrier ribs 130 can be prevented.

In order to prevent brightness reduction due to electromagnetic wave shielding layer 190 formed over the discharge area, width W1 of the grid pattern of electromagnetic wave shielding layer 190 is preferably narrower than width W2 of each barrier rib, as illustrated in FIG. 5. In order to improve the electromagnetic wave shielding efficiency, however, width W1 of the grid pattern of the electromagnetic wave shielding layer can be formed equal to width W2 of the barrier rib. Also, it is possible that the widths of the grid pattern part of electromagnetic wave shielding layer 190 corresponding to first barrier rib portions 130*a* may be different from the widths of the grid pattern part of electromagnetic wave shielding layer 190 corresponding to second barrier rib portions 130*b*.

Electromagnetic wave shielding layer 190 is made from an electrically conductive material, preferably, an electrically conductive metal. Particularly, electromagnetic wave shielding layer 190 can be made from a single, electrically conducting material, such as Ag, Ni, Cu, or Cr, or a combination of these materials, and can be used to ease manufacture and improve electromagnetic wave shielding efficiency.

First dielectric layer ll4 is disposed on front substrate 111 to cover electromagnetic wave shielding layer 190. First dielectric layer 114 prevents sustain electrode pairs 112 and electromagnetic wave shielding layer 190 from being electrically shorted. First dielectric layer 114 may be made from at least one material from the group consisting of PbO, $B_2O_3$, and $SiO_2$.

Sustain electrode pairs 112 are disposed on first dielectric layer 114. Each sustain electrode pair 112 includes a pair of sustain electrodes 131 and 132 disposed on a surface of front substrate 111 that faces rear substrate 121 and are used to cause a sustain discharge. Sustain electrode pairs 112 are arranged in parallel at intervals on front substrate 111. In detail, sustain electrode pair 112 includes an X electrode 131 which functions as a sustain electrode and a Y electrode 132 which functions as a scan electrode.

Each X electrode 131 and Y electrode 132 is constructed with transparent electrodes 131*a* and 132*a* and bus electrodes 131*b* and 132*b*, respectively. Optically transparent electrodes 131*a* and 132*a* are made from a transparent material which is also an electrically conductive material capable of causing a discharge and capable of allowing visible light emitted from phosphor layers 126 to be transmitted through its thickness to front substrate 111. The transparent material may include a material such as Indium Tin Oxide (ITO), etc. However, since a transparent conductor such as ITO generally has a high electrical resistance, if sustain electrode pairs 112 are formed having only transparent electrodes 131*a* and 132*a*, a voltage drop in the longitudinal direction of the electrodes will be large, and thus, a large amount of driving power will be consumed and a response speed will be slow. Accordingly, in order to avoid these problems, bus electrodes 131*b* and 132*b* are made from an electrically conducting metal material having a small width and are disposed on transparent electrodes 131*a* and 132*a*. These transparent electrodes 131*a* and 132*a* and bus electrodes 131*b* and 132*b* may be formed using a photo etching method, a photolithography method, etc.

Hereinafter, the form and the arrangement of X electrodes 131 and Y electrodes 132 will be described in detail. Bus electrodes 131*b* and 132*b* are disposed in parallel with each other, but are spaced apart from each other and correspond to a unit discharge cell 180. Bus electrodes 131*b* and 132*b* extend continuously in an X direction across discharge cells 180. As described above, respective bus electrodes 131*b* and 132*b* are electrically connected to the corresponding transparent electrodes 131*a* and 132*a*. Transparent electrodes 131*a* and 132*a* are formed in a rectangular shape and are discontinuously disposed in each discharge cell 180. One side of each of transparent electrodes 131*a* and 132*a* is connected to bus electrodes 131*b* and 132*b*, and the other side of each of transparent electrodes 131*a* and 132*a* is disposed toward the center of the corresponding discharge cell 180.

Second dielectric layer 115 is disposed over first dielectric layer 114 in order to cover sustain electrode pairs 112. Second dielectric layer 115 prevents adjacent X electrodes 131 and Y electrodes 132 from being electrically connected to each other, and prevents charged particles or electrons from directly contacting X electrodes 131 and Y electrodes 132, and thus, damaging X electrodes 131 and Y electrodes 132. Also, second dielectric layer 115 induces charges. Second dielectric layer 115 can be made from PbO, $B_2O_3$, $SiO_2$, or so on.

Plasma display panel 100 may be further constructed with protection layer 116 for covering second dielectric layer 115. Protection layer 116 prevents charged particles and electrons from contacting second dielectric layer 115, and thus, damaging second dielectric layer 115, when discharge occurs. Protection layer 116 is made from a material having a high secondary electron emission coefficient and a high light transmittance. Protection layer 116 is formed as a thin film by a process such as sputtering, E-Beam evaporation, or so on, after second dielectric layer 115 is formed.

Address electrodes 122 are disposed on a surface of rear substrate 121 that faces front substrate 111. Address electrodes 122 extend in an X direction across discharge cells 180 so as to traverse X electrodes 131 and Y electrodes 132.

Address electrodes 122 are used to form an address discharge to further boost a sustain discharge between X electrodes 131 and Y electrodes 132. In more detail, address electrodes 122 act to lower a voltage required to generate a sustain discharge between X electrodes 131 and Y electrodes 132. The address discharge is generated between Y electrodes 132 and address electrodes 132. When the address discharge is terminated, wall charges are accumulated near Y electrodes 132 and X electrodes 131, so that a sustain discharge between X electrodes 131 and Y electrodes 132 can be easily generated.

A space formed between X electrode 131 and Y electrode 132 of sustain electrode pair 112, arranged as described above, and an address electrode 122 intersecting X and Y electrodes 131 and 132, define unit discharge cell 180.

Third dielectric layer 125 is disposed on rear substrate 121 to cover address electrodes 122. Third dielectric layer 125 is made from a dielectric material, which prevents charged particles or electrons from contacting address electrodes 122, and thus, damaging address electrodes 122. Third dielectric layer 125 is capable of inducing charges when discharge occurs. The dielectric material may be made from PbO, $B_2O_3$, $SiO_2$, etc. Phosphor layers 126 including red-emitting, green-emitting, or blue-emitting phosphors are formed on lateral sides 201 of barrier ribs 130 and on portions of an upper surface 202 of third dielectric layer 125, which faces front substrate 111, where no barrier rib 130 is formed. Phosphor layers 126 absorb ultraviolet light and generate visible light. A phosphor layer formed in a red-emitting discharge cell is made from a phosphor such as $Y(V,P)O_4$:Eu, etc. A phosphor layer formed in a green-emitting discharge cell is made from a phosphor such as $Zn_2SiO_4$:Mn, $YBO_3$:Tb, etc. A phosphor layer formed in a blue-emitting discharge cell is made from a phosphor such as BAM:Eu, etc.

Also discharge cells 180 are filled with a discharge gas comprising gases such as Ne, Xe, etc. After discharge cells 180 are filled with the discharge gas, front substrate 111 and rear substrate 121 are sealed by a sealing material such as frit glass.

Hereinafter, a method for manufacturing front panel 150 of plasma display panel 100 will be described with reference to FIGS. 6A through 6E.

Figure 6A:
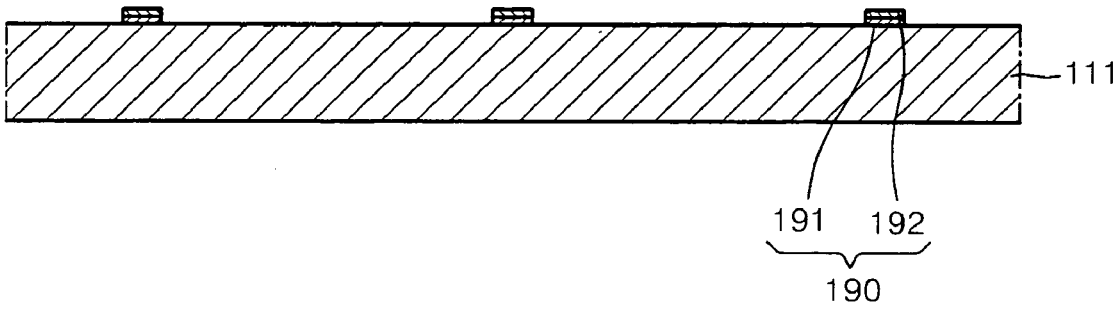
FIGS. 6A through 6E are cross-sectional views for explaining a method for manufacturing a front panel of the plasma display device illustrated in FIG. 3.

FIGS. 6A through 6E are cross-sectional views for explaining a method for manufacturing front panel 150 of plasma display device 100 illustrated in FIG. 3. First, an electrically conductive paste and a photosensitive black paste are printed on front substrate 111 and then an electromagnetic wave shielding layer 190 is formed in a grid pattern using a photo etching method. FIG. 6A shows electromagnetic wave shielding layer 190 disposed on front substrate 111.

Figure 6B:
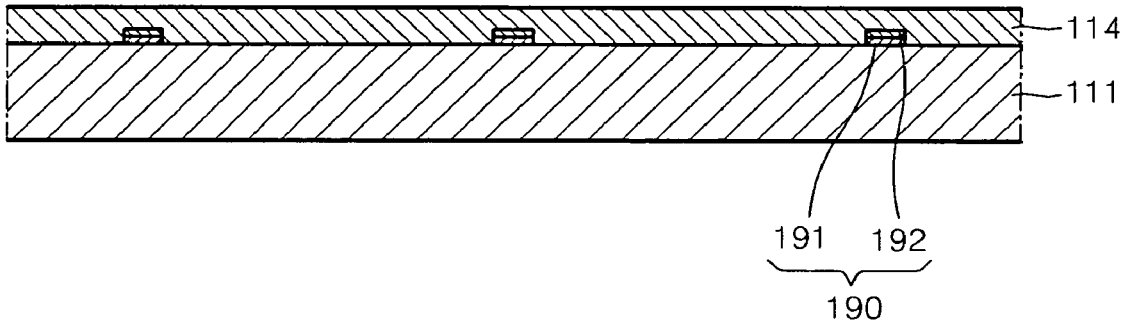

Thereafter, a dielectric paste is printed and dried to cover electromagnetic wave shielding layer 190, thus forming first dielectric layer 114, shown in FIG. 6B.

Figure 6C:
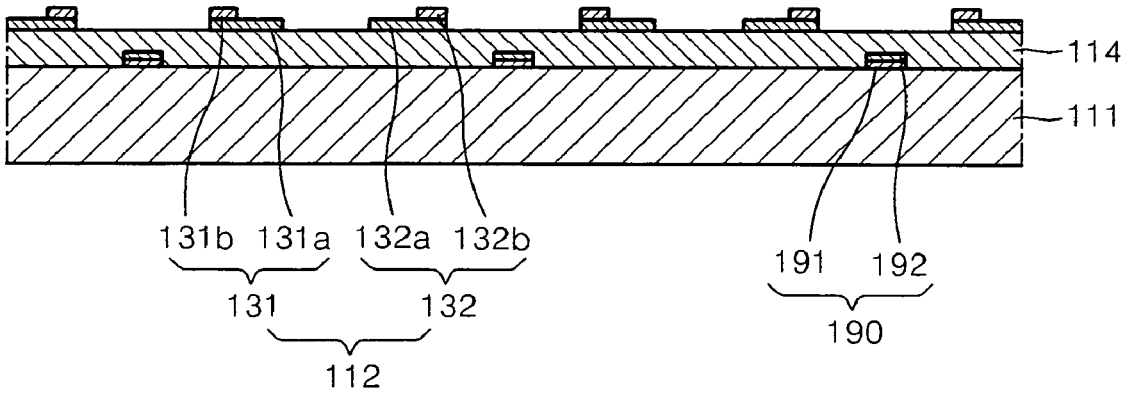

After first dielectric layer 140 is formed, sustain electrode pairs 112 are formed on first dielectric layer 114 by a lift off method, a photosensitive paste method, or a photo etching method. FIG. 6C shows sustain electrode pairs 112 formed on first dielectric layer 114.

Figure 6D:
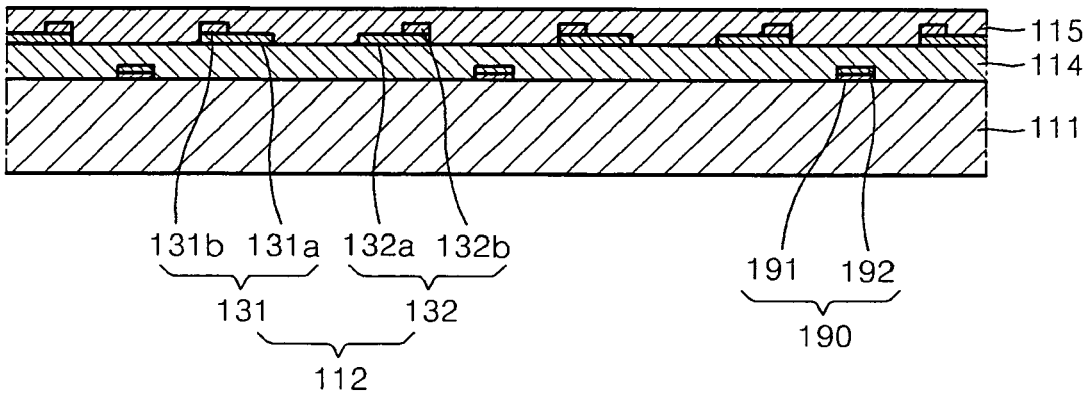

After sustain electrode pairs 112 are formed, a dielectric paste is applied, dried, and fired to cover sustain electrode pairs 112, thereby forming second dielectric layer 115. FIG. 6D shows second dielectric layer 115 formed on first dielectric layer 114.

Figure 6E:
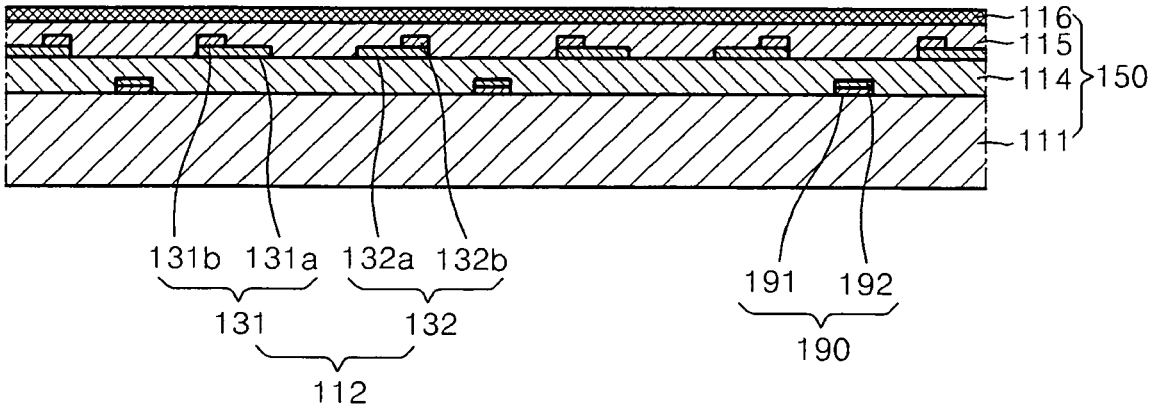

After second dielectric layer 115 is formed, protection layer 116 is formed by a method such as sputtering, or so on, thus completing formation of front panel 150. FIG. 6E shows protection layer 116 formed on second dielectric layer 115.

The operation of plasma display panel 100 according to the present invention, constructed as described above, will be described as follows.

Plasma discharge generated in plasma display panel 100 is largely divided into address discharge and sustain discharge. The address discharge is generated by applying an address discharge voltage between address electrodes 122 and Y electrodes 132. Discharge cells 180 in which a sustain discharge will be generated are selected due to the address discharge.

Then, a sustain voltage is applied between X electrodes 131 and Y electrodes 132 of selected discharge cells 180. Thus, when X electrodes 131 are positively biased and Y electrodes 132 are negatively biased, positive ions accumulated near Y electrodes 132 collide with electrons accumulated near X electrodes 131 so that sustain discharge is generated. Then, sustain voltage pulses are reversely applied to X electrodes 131 and Y electrodes 132, i.e., X electrodes 131 are negatively biased and Y electrodes 132 are positively biased. Thus, electrons accumulated near Y electrodes 132 collide with positive ions accumulated near X electrodes 131 so that a sustain discharge is generated. In this way, sustain voltage pulses are alternately applied to X electrodes 131 and Y electrodes 132 so that sustain discharge is continuously generated.

Ultraviolet light is emitted when the discharge gas which has been excited by the sustain discharge drops to a lower energy state. The ultraviolet light excites the phosphors of phosphor layers 126 formed in discharge cells 180. Then visible light is emitted when the excited phosphors of phosphor layers 126 drop to a lower energy state. When the visible light emerges through front substrate 111, an image can be formed.

Figure 7:
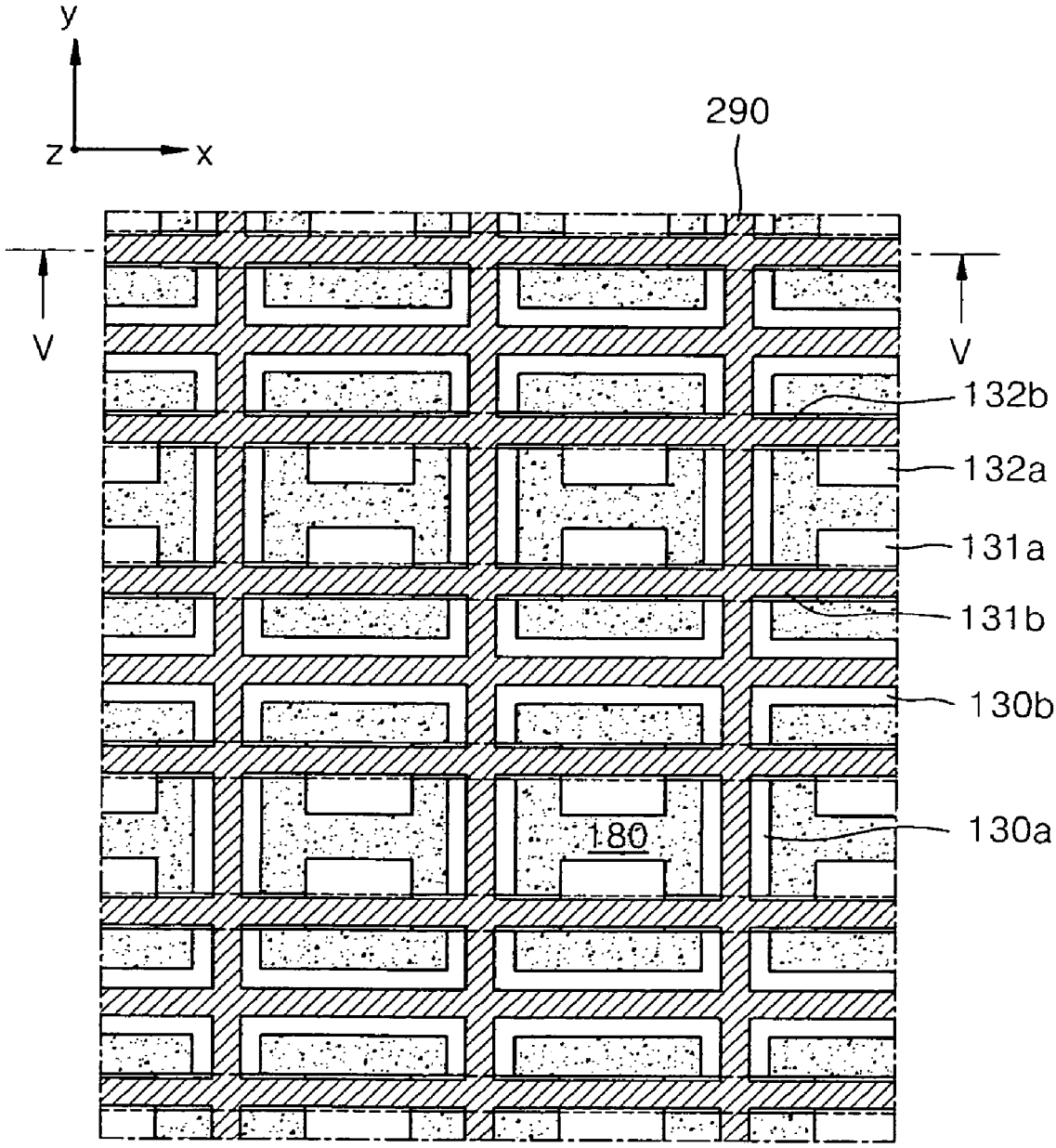
FIG. 7 is a plan view showing an arrangement of sustain electrode pairs, barrier ribs, and an electromagnetic wave shielding layer of a plasma display panel constructed as a second embodiment of the principles of the present invention.
Figure 8:
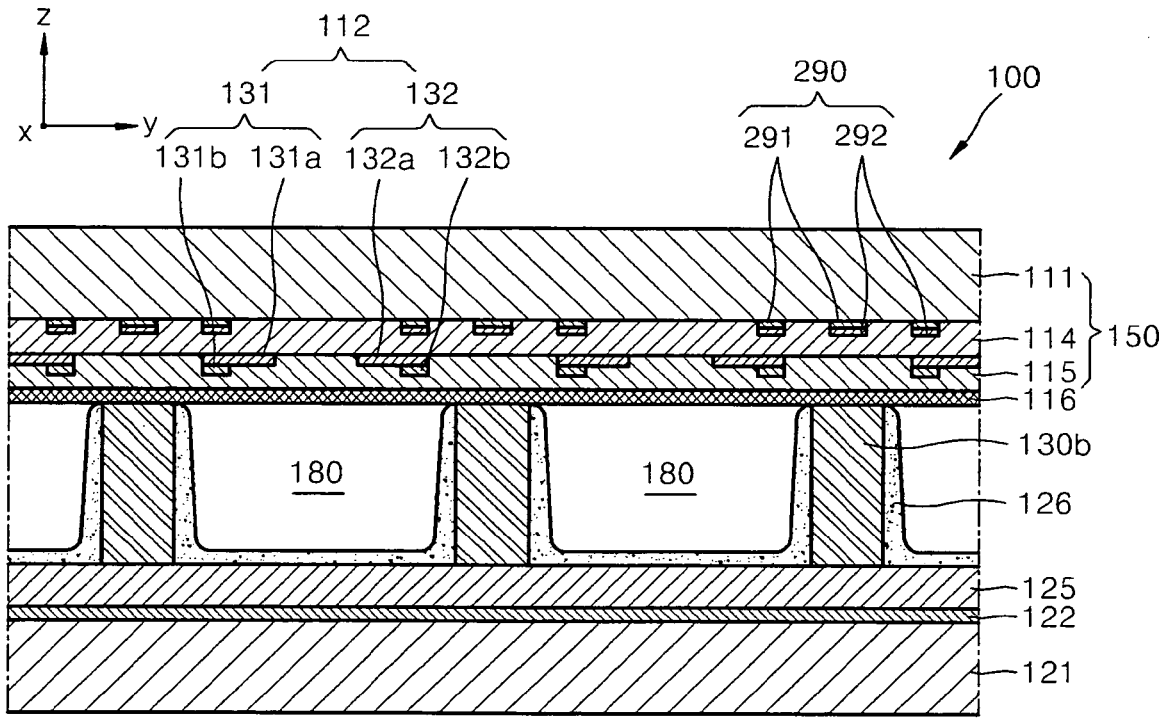
FIG. 8 is a cross-sectional view of the plasma display panel of FIG. 7 taken along line V-V of FIG. 7, according to the second embodiment of the principles of the present invention.

FIGS. 7 and 8 are views of a plasma display panel constructed as a second embodiment according to the principles of the present invention. FIG. 7 is a plan view showing an arrangement of sustain electrode pairs, barrier ribs, and an electromagnetic wave shielding layer of the plasma display panel. FIG. 8 is a cross-sectional view of the plasma display panel of FIG. 7 taken along line V-V of FIG. 7. In FIGS. 7 and 8, the same reference numbers as in the first embodiment represent the same components of the first embodiment. Hereinafter, a difference between the first embodiment and the second embodiment will be described.

The second embodiment differs from the first embodiment in terms of the arrangement of electromagnetic wave shielding layer 290. Referring to FIGS. 7 and 8, electromagnetic wave shielding layer 290 is formed in a grid pattern. The grid pattern of electromagnetic wave shielding layer 290 is formed in alignment with barrier ribs 130 and bus electrodes 131*b* and 132*b*. Generally, bus electrodes 131*b* and 132*b* are formed in a multi-layer structure using a metal, such as Ag, Al, or Cu. Particularly, layers of front panel 150 near front substrate 111 are tinted in order to improve contrast, and layers near discharge cells 180 are transparent in order to improve brightness. Accordingly, when a user sees bus electrodes 131*b* and 132*b* from the outside, the user will recognize that bus electrodes 131*b* and 132*b* are tinted. Furthermore, although the grid pattern of electromagnetic wave shielding layer 290 is formed corresponding to bus electrodes 131*b* and 132*b*, it is possible to further improve electromagnetic wave shielding efficiency without reducing brightness.

Figure 9A:
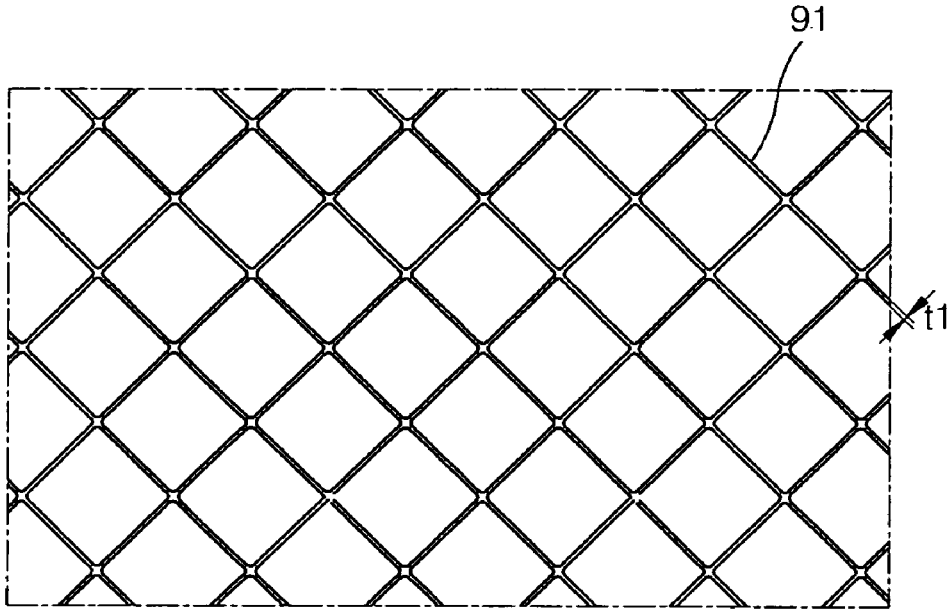
FIG. 9A is a partially enlarged plan view showing the structure of a film-type filter according to a first comparison example.
Figure 9B:
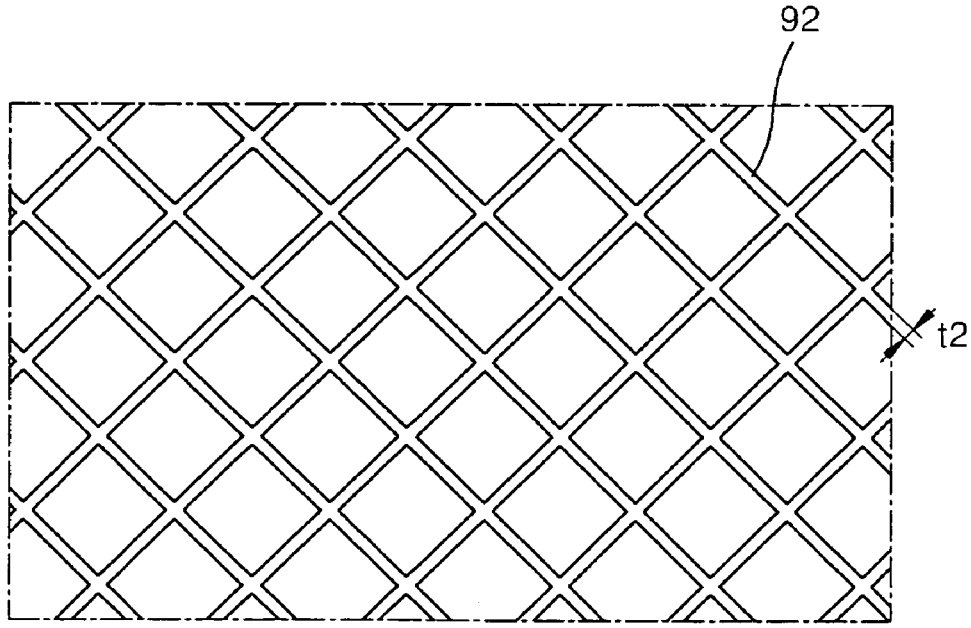
FIG. 9B is a partially enlarged plan view showing the structure of a film-type filter according to a second comparison example.
Figure 10:
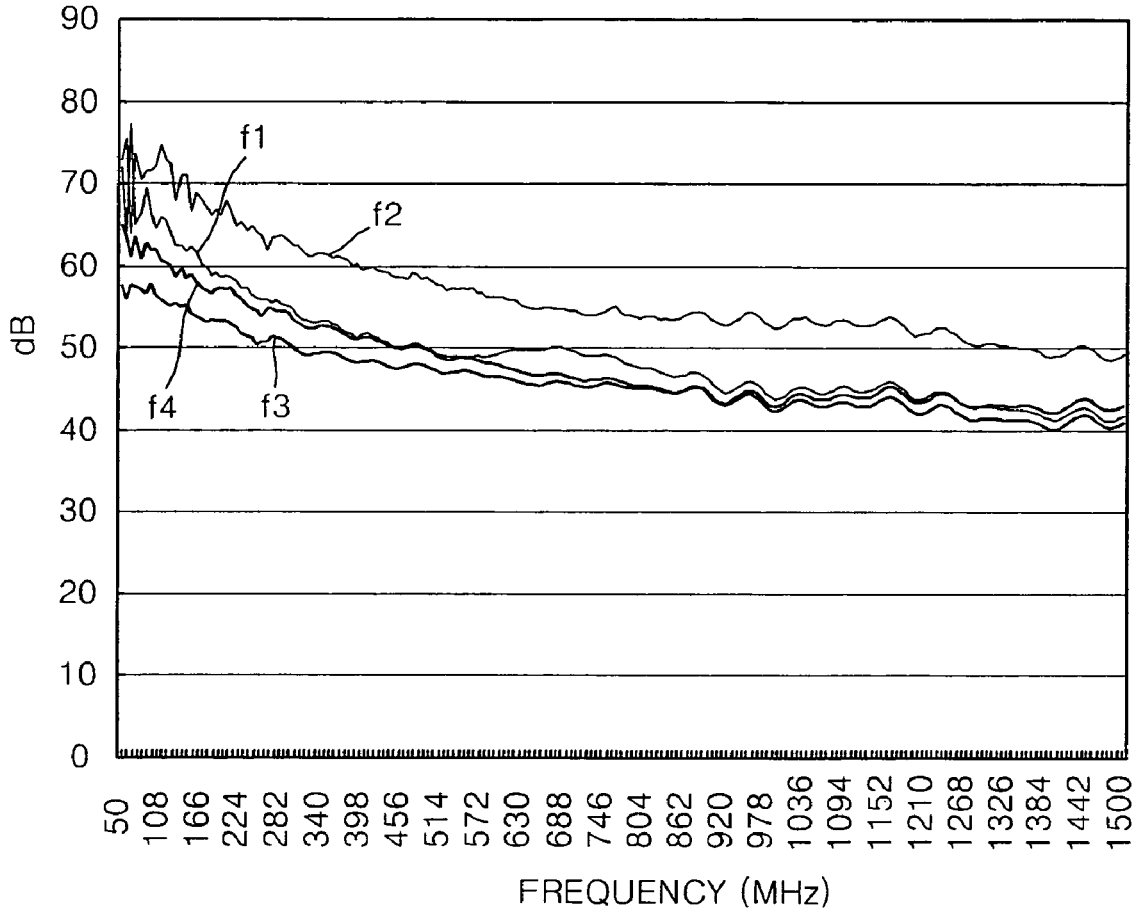
FIG. 10 is a graph of experimental results showing electromagnetic wave shielding efficiency with respect to frequency, of the embodiments of the present invention, and of the comparison examples.

FIG. 10 is a graph of experimental results showing electromagnetic wave shielding efficiency with respect to frequency, according to embodiments of the present invention and two comparison examples shown in FIGS. 9A and 9B. In FIG. 10, the y-axis of the graph represents the amount of electromagnetic wave shielded by the electromagnetic wave shielding layer.

In FIG. 10, a first plot f1 represents an electromagnetic wave shielding efficiency of a plasma display panel according to the first embodiment of the present invention, that is, a representation of how much the EM radiation is reduced, and a second plot f2 represents an electromagnetic wave shielding efficiency of a plasma display panel according to the second embodiment of the present invention. FIG. 9A is a partially enlarged plan view showing the structure of a film-type filter as illustrated in FIG. 2, formed on a front surface of a plasma display panel which is facing the viewer, according to a first comparison example, and FIG. 9B is a partially enlarged plan view showing the structure of a film-type filter as illustrated in FIG. 2, formed on a front surface of a plasma display panel which is facing the viewer, according to a second comparison example. Referring to FIG. 9A, the film type filter of the first comparison example is formed in a grid pattern 91 where a width t1 of grid pattern 91 is 10 μm and an opening ratio is 93%. Referring to FIG. 9B, the film type filter of the second comparison example is formed in a grid pattern 92 where a width t2 of the grid pattern is 26 μm and an opening ratio is 80%. The opening ratio is the ratio between the area that is not occupied by the grid pattern and the total area of the visual display, where the total area of the visual display is typically constant between comparative examples. Plots of electromagnetic wave shielding efficiency with respect to frequency corresponding to the first comparison example and the second comparison example are represented as a third plot f3 and a fourth plot f4, respectively, shown on FIG. 10.

Referring to FIG. 10, the electromagnetic wave shielding efficiency plots of the first and second embodiments are superior to the electromagnetic wave shielding efficiencies of the first and second comparison examples, over almost the entire frequency range.

Electromagnetic waves ranging between frequencies of 50 and 230 MHz can adversely affect electronic devices and are harmful to humans and as such are unwanted. It can be seen from FIG. 10 that the mean values of the electromagnetic wave shielding efficiencies in a range of 50 to 230 MHz of the first embodiment, the second embodiment, the first comparison example, and the second comparison example are 64.3 dB, 69.4 dB, 59.4 dB, and 59.9 dB, respectively. That is, the electromagnetic wave shielding efficiencies of the first and second embodiments are higher by about 5 to 10 dB than those of the first and second comparison examples.

The plasma display panel according to the present invention has the following advantages.

First, electromagnetic wave shielding efficiency is improved.

Second, since an electromagnetic wave shielding layer is integrally formed as part of a front substrate, the electromagnetic wave shielding layer can be easily manufactured. Also, since separate tempered glass filters or film-type filters are not required, the plasma display panel can be easily manufactured.

While the present invention has been particularly shown and described with reference to exemplary embodiments thereof, it will be understood by those of ordinary skill in the art that various changes in form and details may be made therein without departing from the spirit and scope of the present invention as defined by the following claims.

The mesh pattern of the electromagnetic wave shielding filter is not confined to a rectilinear geometric shape, and could have other geometric shapes such as en ellipsoidal shape, circular shape or triangular shape.

What is claimed is:

1. A plasma display panel, comprising:

a front substrate and a rear substrate, disposed facing each other and forming a discharge space therebetween;

a plurality of barrier ribs disposed between the front substrate and the rear substrate, partitioning a plurality of discharge cells;

a bus electrode disposed on the front substrate; and an electromagnetic wave shielding layer disposed on a surface of the front substrate that faces the rear substrate, the electromagnetic wave shielding layer being separated from the barrier ribs, with the electromagnetic wave shielding layer disposed as a plurality of lines forming a grid pattern, and the width of each of the lines in the grid pattern being equal to or narrower than the width of each barrier rib, and the bus electrode lying wholly within the outlines of the electromagnetic wave shielding layer.

2. The plasma display panel of claim 1, with the electromagnetic wave shielding layer being separated from the barrier ribs by at least a dielectric layer covering the electromagnetic wave shielding layer.

3. The plasma display panel of claim 1, with the electromagnetic wave shielding layer forming a grid pattern or a mesh pattern.

4. The plasma display panel of claim 1, with the electromagnetic wave shielding layer comprising:

a first shielding portion having a light absorption property, disposed on the front substrate; and a second electrically conductive shielding portion disposed on the first shielding portion.

5. The plasma display panel of claim 1, with the electromagnetic wave shielding layer in conformance with a non-discharge region.

6. The plasma display panel of claim 1, with the electromagnetic wave shielding layer comprising an electrically conductive metal.

7. The plasma display panel of claim 6, with the electrically conductive metal comprising at least one material selected from the group consisting essentially of Ag, Ni, Cu, and Cr.

8. The plasma display panel of claim 1, further comprising a dielectric layer covering the electromagnetic wave shielding layer.

9. A plasma display panel, comprising:

a front substrate and a rear substrate disposed facing each other;

a plurality of barrier ribs disposed between the front substrate and the rear substrate, partitioning a plurality of discharge cells;

an electromagnetic wave shielding layer disposed between the front substrate and the barrier ribs;

a first dielectric layer covering the electromagnetic wave shielding layer;

a plurality of sustain electrode pairs disposed on the first dielectric layer and used to generate discharge in the discharge cells;

a second dielectric layer covering the sustain electrode pairs;

a plurality of address electrodes disposed between the barrier ribs and the rear substrate and extending in a direction traversing the sustain electrode pairs;

a third dielectric layer covering the address electrodes; and phosphor layers formed in the discharge cells, with the electromagnetic wave shielding layer disposed as a plurality of lines forming a grid pattern, and the width of each of the lines in the grid pattern being equal to or narrower than the width of each barrier rib, each sustain electrode comprising a bus electrode extending in a direction traversing the address electrodes and lying wholly within the outlines of the electromagnetic wave shielding layer.

10. The plasma display panel of claim 9, with the electromagnetic wave shielding layer forming a grid pattern or a mesh pattern.

11. The plasma display panel of claim 9, with the electromagnetic wave shielding layer comprising:

a first shielding portion having a light absorption property, disposed on the front substrate; and a second electrically conductive shielding portion disposed on the first shielding portion.

12. The plasma display panel of claim 9, with the electromagnetic wave shielding layer overlying in alignment with a non-discharge region.

13. The plasma display panel of claim 9, with the electromagnetic wave shielding layer overlying in alignment with the barrier ribs.

14. The plasma display panel of claim 9, with each sustain electrode comprising a transparent electrode electrically connected to the bus electrode, with the electromagnetic wave shielding layer being arranged between the bus electrodes and the front substrate.

15. The plasma display panel of claim 14, with the electromagnetic wave shielding layer overlying in alignment with the bus electrodes and the barrier ribs.

16. The plasma display panel of claim 14, with the width of the grid pattern being equal to or narrower than the width of each bus electrode.

17. The plasma display panel of claim 9, with each sustain electrode comprising a bus electrode extending in a direction traversing the address electrode and a transparent electrode electrically connected to the bus electrode, with the electromagnetic wave shielding layer being arranged between the bus electrodes and the front substrate, and between the barrier ribs and the front substrate.

18. The plasma display panel of claim 9, with the electromagnetic wave shielding layer comprising an electrically conductive metal.

19. The plasma display panel of claim 18, with the electrically conductive metal comprising at least one material of Ag, Ni, Cu, and Cr.

20. A plasma display panel, comprising:

a front substrate and a rear substrate, disposed facing each other;

a plurality of barrier ribs disposed between the front substrate and the rear substrate, partitioning a plurality of discharge cells;

a bus electrode disposed on the front substrate; and an electromagnetic wave shielding layer disposed between the front substrate and the barrier ribs, aligned with and overlying the barrier ribs, with the electromagnetic wave shielding layer disposed as a plurality of lines forming a grid pattern, and the width of each of the lines in the grid pattern being equal to or narrower than the width of each barrier rib, and the bus electrode lying wholly within the outlines of the electromagnetic wave shielding layer.

21. A plasma display panel, comprising:

a front substrate and a rear substrate, disposed facing each other;

a plurality of barrier ribs disposed between the front substrate and the rear substrate, partitioning a plurality of discharge cells;

an electromagnetic wave shielding layer disposed between the front substrate and the barrier ribs, aligned with and overlying the barrier ribs and an non-transparent electrode, with the non-transparent electrode lying wholly within the outlines of the electromagnetic wave shielding layer.

* * * * *